United States Patent [19]

Fujita

[11] Patent Number: 5,006,839

[45] Date of Patent: Apr. 9, 1991

[54] METHOD FOR DRIVING A LIQUID CRYSTAL OPTICAL APPARATUS

[75] Inventor: Masanori Fujita, Tokyo, Japan

[73] Assignee: Seikosha Co., Ltd., Japan

[21] Appl. No.: 216,388

[22] Filed: Jul. 7, 1988

[30] Foreign Application Priority Data

Jul. 14, 1987 [JP] Japan ..... 62-175134

[51] Int. Cl.[5] ..... G09G 3/36

[52] U.S. Cl. ..... 340/784; 340/805; 350/350 S

[58] Field of Search ..... 340/784, 805; 350/350 S, 332

[56] References Cited

U.S. PATENT DOCUMENTS

| | | | |
|---|---|---|---|
| 4,725,688 | 2/1988 | Taguchi et al. | 350/350 S |
| 4,765,720 | 8/1988 | Toyono et al. | 350/350 S |
| 4,770,502 | 9/1988 | Kitazima et al. | 350/350 S |
| 4,773,738 | 9/1988 | Hayakawa | 350/350 S |
| 4,834,510 | 5/1989 | Fujita | 350/350 S |

OTHER PUBLICATIONS

"An Application of Chiral Smectic-C Liquid Crystal to a Multiplexed Large-Area Display" by Harada et al., SID 85 Digest, 1985, pp. 131-134.

*Primary Examiner*—Jeffery A. Brier

*Attorney, Agent, or Firm*—Bruce L. Adams; Van C. Wilks

[57] ABSTRACT

In the method for driving a liquid crystal optical apparatus of the present invention, the initialization signals are supplied, for the sequential display, to the scanning electrode groups of display elements, the selection signal is then supplied following such initialization signals, after initializing the ferroelectric liquid crystal to the saturated reverse response condition depending on a voltage difference between the desired signal supplied to the control electrode group and such initialization signal, a pulse group for initializing the liquid crystal up to the response condition less than the threshold value for obtaining such response condition is applied, the response control pulse group for attaining the desired response condition of the ferroelectric liquid crystal is subsequently applied depending on the voltage difference between the selection signal supplied and such desired signal, the scanning period of selection signal can be shortened by obtaining the desired response condition through cooperation of the initialization pulse groups and response control pulse groups, and the write period of single display frame can be curtailed remarkably by previous initialization of the next line simultaneously with application of the selection signal.

9 Claims, 13 Drawing Sheets

METHOD FOR DRIVING A LIQUID CRYSTAL OPTICAL APPARATUS

BACKGROUND OF THE INVENTION

[Industrial Applicability]

The present invention relates to a method for driving a liquid crystal optical apparatus consisting of ferroelectric liquid crystal.

[Prior Art]

Recently, the ferroelectric liquid crystal is watched with attention, in place of a TN type liquid crystal and a display apparatus utilizing it is now under development.

The display mode of ferroelectric liquid crystal includes the complex refraction type display mode and guest host type display mode. On the occasion of driving these display modes, unlike the conventional TN type liquid crystal, the driving method which has been used for the TN type liquid crystal cannot be employed because the display condition (contrast) is controlled depending on the direction of applying electric field and therefore a special driving method is required.

Moreover, when the service life of display apparatus is considered, it is not desirable that the DC element is applied for a long period to the display element and accordingly a driving method considering it is necessary.

A driving method not allowing application of such DC element to the display element for a long period is disclosed in the "SID' 85 Digest" (1985) (P.131 P134). Moreover, the Japanese Laid-Open Patent 60-176097 also discloses a method for driving display apparatus which realizes bistability of display with a driving electrical signal utilizing the ferroelectric liquid crystal having the AC stabilizing effect.

[Problems to be Solved by the Invention]

However, the latter driving method sometimes allows application of DC element to the display element for a long period and thereby results in a problem that the transparent electrode for display is reduced and shows blackening or that the pigment of dichroism discolors or the liquid crystal is deteriorated. Meanwhile, the former driving method does not result in a problem of deterioration of liquid crystal but a problem, when the time required for writing a pixel is t, that the time T required for rewriting a display format is expressed as $T=4\times t\times N$ (N is a number of scanning lines/format) and thereby the number of scanning lines cannot be increased because the rewriting time T becomes longer and accordingly it is undesirable for a display of a dynamic picture In addition, the display of intermediate color tone has also been impossible.

DETAILED DESCRIPTION OF THE INVENTION

Figure 1:
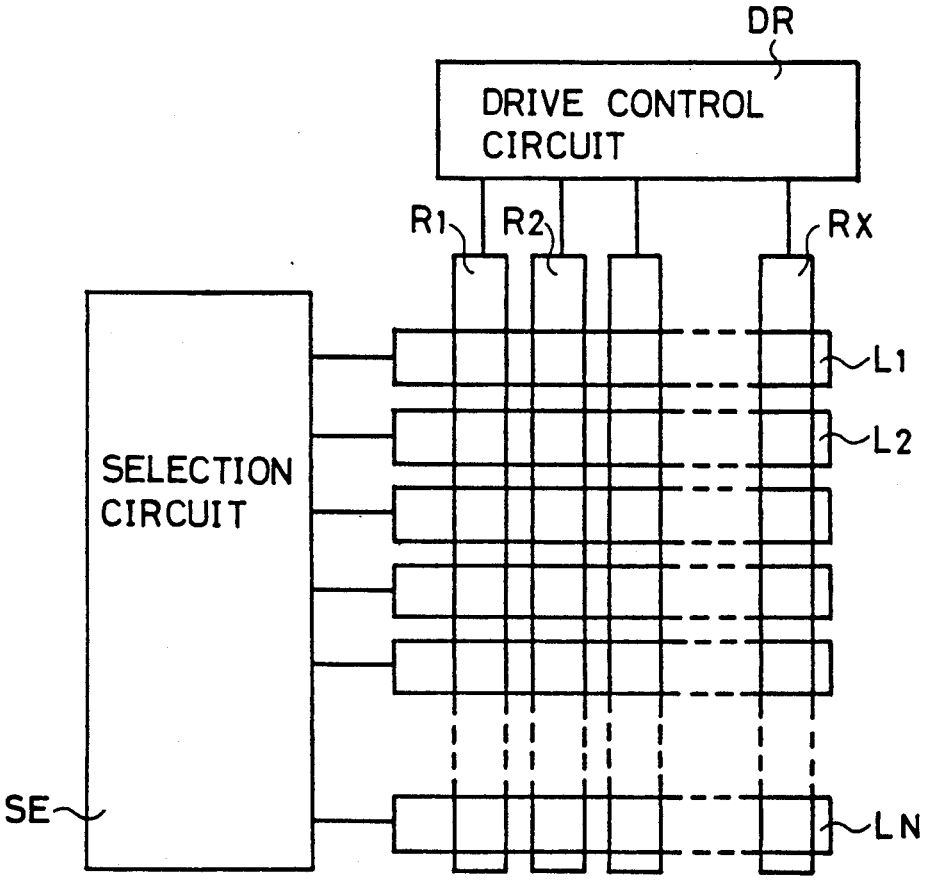
FIG. 1 shows an example of the display apparatus.
Figure 2:
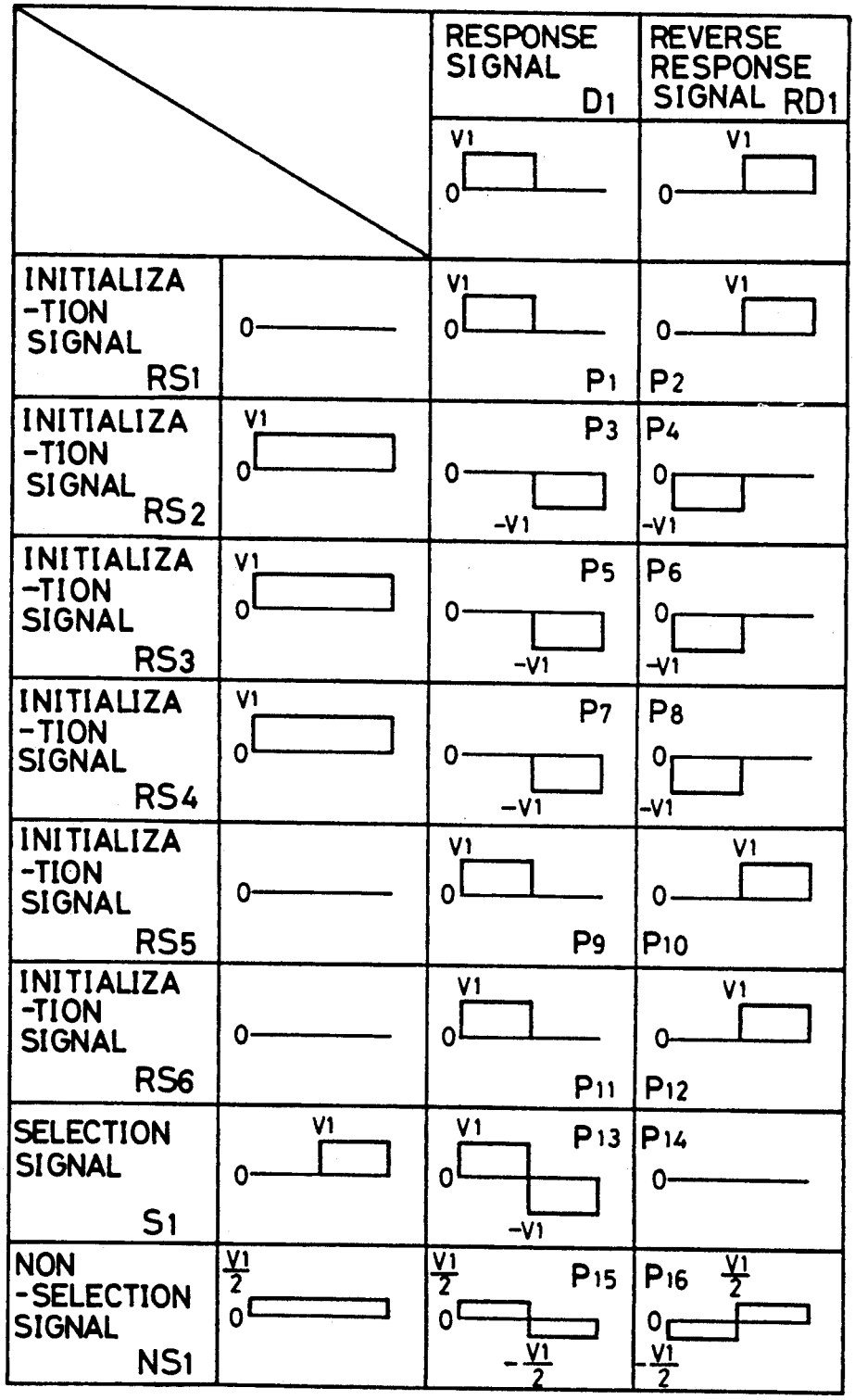
FIG. 2 shows voltage waveforms for realizing the present invention.
Figure 3:
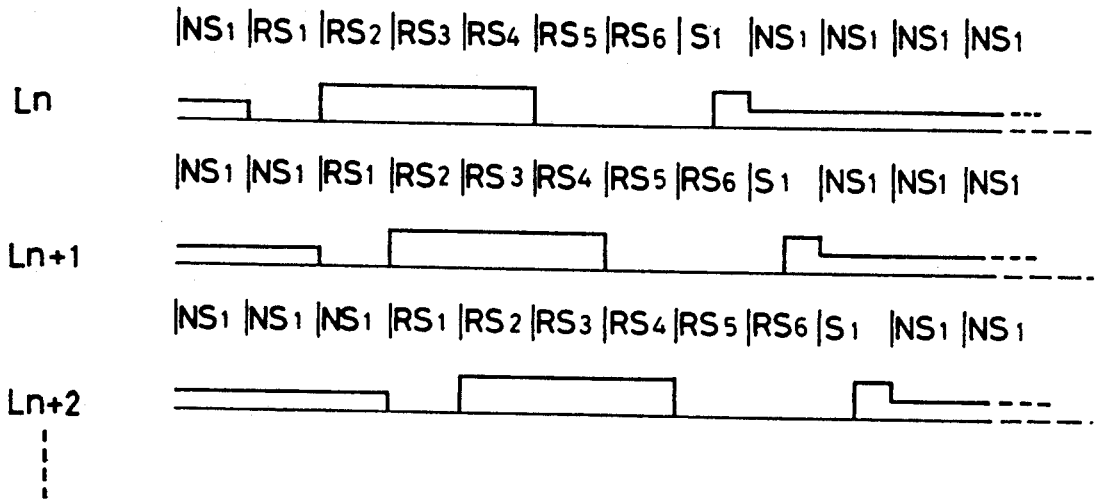
FIG. 3 shows the timings for applying the signals to the scanning electrode groups L1~LN.

In FIG. 1 and FIG. 2, initialization signals $RS_1$, $RS_2$, $RS_3$, $RS_4$, $RS_5$, $RS_6$ (FIG. 2) which sequentially initialize on a time division basis the scanning electrode groups $L_1 \sim L_N$ and the selection signal $S_1$ (FIG. 2) which selects such scanning electrodes are generated from the selection circuit SE in the timing indicated in FIG. 3, and the nonselection signal $NS_1$ (FIG. 2) is generated when such initialization signals and selection signal are not supplied.

The initialization signals $RS_1$, $RS_5$, $RS_6$ are composed of the voltage 0, while $RS_2$, $RS_3$, $RS_4$, of the voltage $V_1$, the selection signal $S_1$, of the voltages 0 and $V_1$ and the nonselection signal $NS_1$, of the voltage $V_1/2$.

On the other hand, the response signal $D_1$ or reverse response signal $RD_1$ shown in FIG. 2 is generated from the drive control circuit DR and is then supplied to the control electrode groups $R_1 \sim R_X$, corresponding to the desired display condition of pixels on the lines to which the selection signal $S_1$ is applied. Namely, the response signal $D_1$ is supplied to the control electrode to be the response display and the reverse response signal $RD_1$ to the control electrode to be the reverse response display. The response signal $D_1$ is composed of the voltages $V_1$ and 0 and the reverse response signal $RD_1$, of the voltages 0 and $V_1$. The ferroelectric liquid crystal is provided between the scanning electrode group and control electrode group.

When the signals mentioned above are supplied, the pulse group $P_1$ or $P_2$ is applied by the supply of the initialization signal $RS_1$ to the response pixels, thereafter the pulse group $P_5$ or $P_6$, moreover $P_7$ or $P_8$ of the same polarity are supplied, following pulse group $P_3$ or $P_4$, for initialization of pixels to the saturated reverse response condition by the supply of the initialization signals $RS_2$, $RS_3$ and $RS_4$, moreover, the pulse group $P_9$ or $P_{10}$ and the pulse group $P_{11}$ or $P_{12}$ are supplied to initialize the pixels to the response condition lower than the threshold value, and thereafter the pulse group $P_{13}$ is applied by the selection signal $S_1$ and response signal $D_1$. In the case of the pulse group $P_{13}$, the voltage $V_1$ is first applied and therefore the pixels are set to the saturated response condition by cooperation of such pulse group $P_9$ or $P_{10}$ and $P_{11}$ or $P_{12}$. Thereafter, the voltage $-V_1$ is applied but this pulse does not change the response condition. After application of the pulse group $P_{13}$, the pulse group $P_{15}$ or $P_{16}$ is applied by the nonselection signal $NS_1$, but the response condition does not change because the voltage is low and such saturated response condition is sustained.

Meanwhile, after application of the pulse group $P_1$ or $P_2$, the pulse group $P_3$ or $P_4$ and pulse group $P_5$ or $P_6$ and $P_7$ or $P_8$ are also supplied to the reverse response pixels for initialization to the saturated reverse response condition, moreover the pulse group $P_9$ or $P_{10}$ and pulse group $P_{11}$ or $P_{12}$ are supplied to such reverse response pixels for initialization to the response condition lower than the threshold value, and thereafter the pulse group $P_{14}$ of voltage 0 is supplied thereto by the selection signal $S_1$ and reverse response signal $RD_1$. In this case, the reverse response pixels are not set to the saturated response condition and are sustained in the saturated reverse response condition. Even after application of the pulse group $P_{14}$, the pulse group $P_{15}$ or $P_{16}$ is applied to the reverse response pixels, and thereby these pixels are not set to the response condition and are sustained under the saturated reverse response condition.

Figure 4:
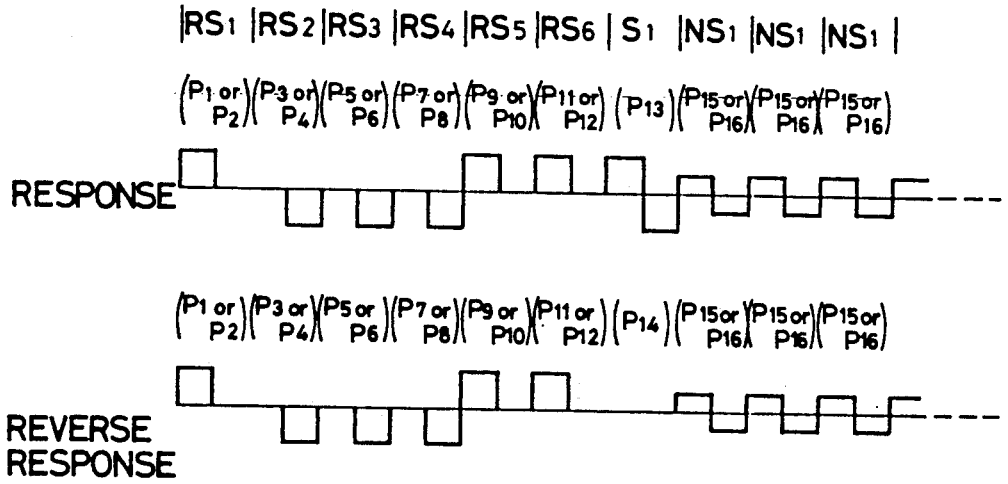
FIG. 4 shows waveforms of pulse examples to be applied to the response display elements and reverse response display elements.

FIG. 4 shows examples of waveforms to be applied to these response and reverse response pixels.

Since the pulse groups applied to the pixels are formed by AC pulses of opposite polarities in which the number and waveform of the pulses of each polarity are the same, blackening of transparent electrodes, deterioration of liquid crystal and discoloration of pigment of dichroism do not occur. Namely, a difference of polarities between the pulse group for initializing the pixels to the saturated reverse response condition and the pulse group for initializing pixels to the response condition less than the threshold value is adjusted by the initialization signal $RS_1$. Since the response condition does not change by the pulse groups $P_1$, $P_2$ applied to the pixels due to the supply of such initialization signal $RS_1$, the stabilized dark level can be obtained by setting the reverse response condition to the dark condition and thereby a high contrast display can be realized.

Figure 5:
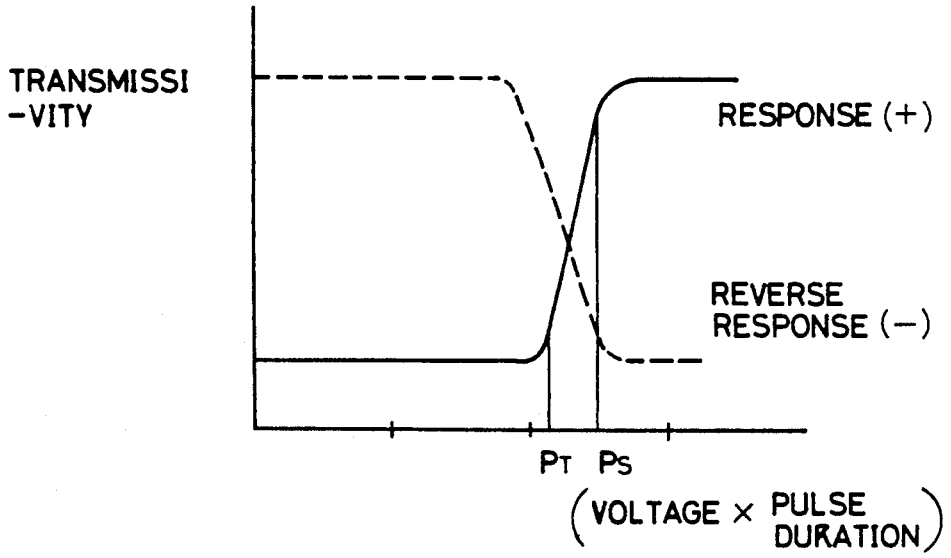
FIG. 5 shows response characteristics of ferroelectric liquid crystal.

Introduction of the initialization signal makes possible the supply of selection signal and simultaneously the preceding initialization of the next line and moreover since the line is initialized up to the response condition near to the threshold value, the pulse duration of the selection signal can be reduced, scanning can be realized within a short period and thereby the display renewal time can be shortened remarkably. Namely, since the response characteristic of the ferroelectric liquid crystal corresponds almost to (voltage x pulse duration) as shown in the FIG. 5, in case where the voltage is constant, the selection signal is only required to have a pulse duration longer than the width corresponding to difference between $P_S$ (FIG. 5) required for saturated response and $P_T$ when response is carried out near to the threshold value $P_T$ (FIG. 5) by the initialization and thereby the scanning can be realized within a short period. Moreover, in the case where the scanning time is set to a constant time, driving can be realized with a low voltage because the drive voltage $V_1$ can be lowered.

The pulse amplitude $V_1$, pulse width and a number of initialization signals are adequately determined, due to the relation between amplitude of self-generating polarization of ferroelectric liquid crystal, display cell thickness and response rise characteristic $[(P_S-P_T)/P_t]$, so that the initialization can be made up to the response condition less than the threshold value $P_T$ with the initialization signal after the saturated reverse response condition and the saturated response condition can be obtained with cooperation of the initialization signal and selection signal. Moreover, the threshold value $P_t$ and saturated value $P_S$ are generally set to the values where transmissivity changes for 10% and 90%, but these are not limited only to these values. A value changing the response condition may be used as the threshold value and a value not changing such response condition may be used as a saturated value.

An example of displaying intermediate tone will be explained next.

Figure 6:
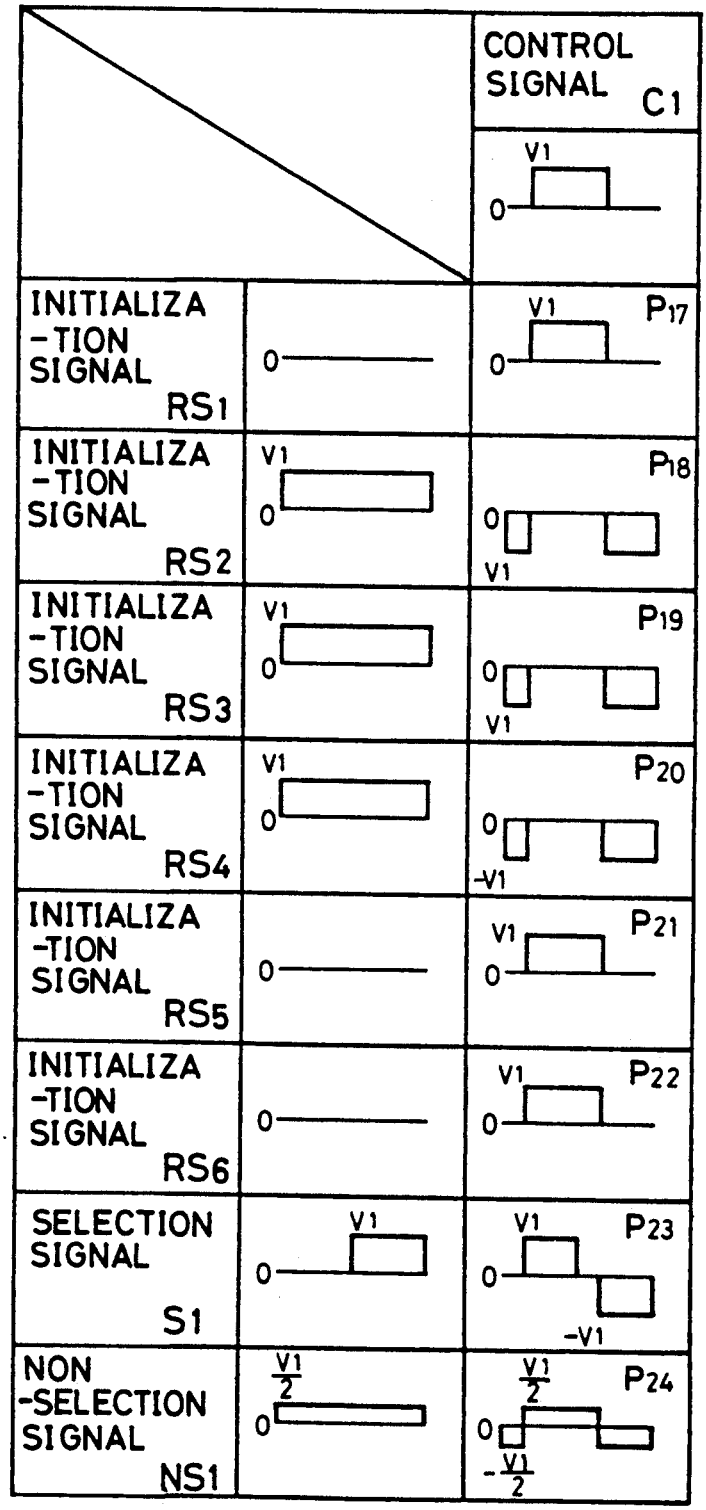
FIGS. 6~14 respectively show other waveform examples for realizing the present invention.

FIG. 6 shows an example of displaying the intermediate tone by utilizing an example of FIG. 2. In FIG. 6, the initialization signals $RS_1$, $RS_2$, $RS_3$, $RS_4$, $RS_5$, $RS_6$, the selection signal $S_1$ and nonselection signal $SN_1$ are the same as those used in FIG. 2, and the phase of control signal $C_1$ supplied to the control electrodes group $R_1 \sim R_X$ can be controlled depending on the gradation.

In FIG. 6, after application of the pulse group $P_{17}$ by the supply of the initialization signal $RS_1$ and control signal $C_1$, the pulse groups $P_{18}$, $P_{19}$, $P_{20}$ are continuously supplied to the pixels by the supply of the initialization signals $RS_2$, $RS_3$, $RS_4$ and the control signal $C_1$ in order to initialize the pixels to the saturated reverse response condition. Moreover, the pulse groups $P_{21}$, $P_{22}$ are continuously supplied to the pixels by the supply of the initialization signals $RS_5$, $RS_6$ and the control signal $C_1$ in order to initialize the pixels to the response condition less than the threshold value. Thereafter, the pulse group $P_{23}$ is applied to the pixels by the supply of selection signal $S_1$. Since the pulse duration of voltage $V_1$ of the pulse group $P_{23}$ changes depending on the gradation, a non-saturated response condition (intermediate tone) can be displayed by application of this pulse.

Namely, in the case where the control signal $C_1$ has the same phase as the response signal $D_1$ of FIG. 2, the saturated response condition can be attained, in the case where the control signal $C_1$ the same phase as the reverse response signal $RD_1$ of FIG. 2, the saturated reverse response condition can be obtained and in the case where the control signal $C_1$ has an intermediate phase, the non-saturated response condition can be obtained.

Thereafter, the pulse group $P_{24}$ is applied by the nonselection signal $NS_1$ and the control signal $C_1$, but the voltage is low and the response condition does not change and the response condition including such intermediate tone can be sustained.

Figure 7:
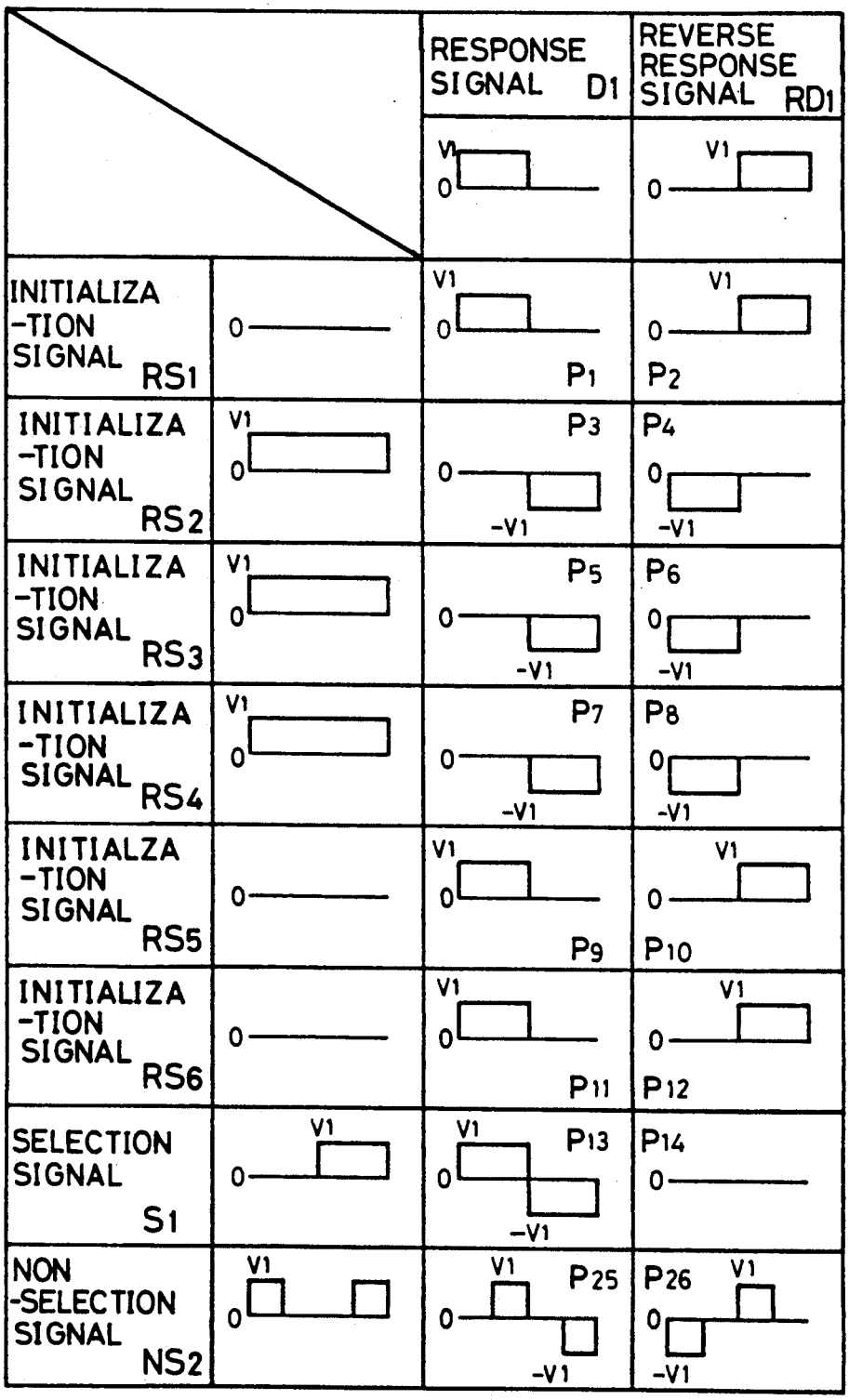

FIG. 7 shows another waveform example of the present invention and the display apparatus can be driven in the same way as FIG. 2. The initialization signals $RS_1$, $RS_2$, $RS_3$, $RS_4$, $RS_5$, $RS_6$, the selection signal $S_1$, the response signal $D_1$ and reverse response signal $RD_1$ are the same as those in FIG. 2 and the nonselection signal $NS_2$ is formed by the voltages 0 and $V_1$ like the other signals.

Thereby, all signals required for driving can be generated by only one power source voltage, the drive circuit structure can be simplified and stable driving can be realized for a wider temperature range only by controlling such voltage $V_1$ depending on temperature, for temperature change.

Figure 8:
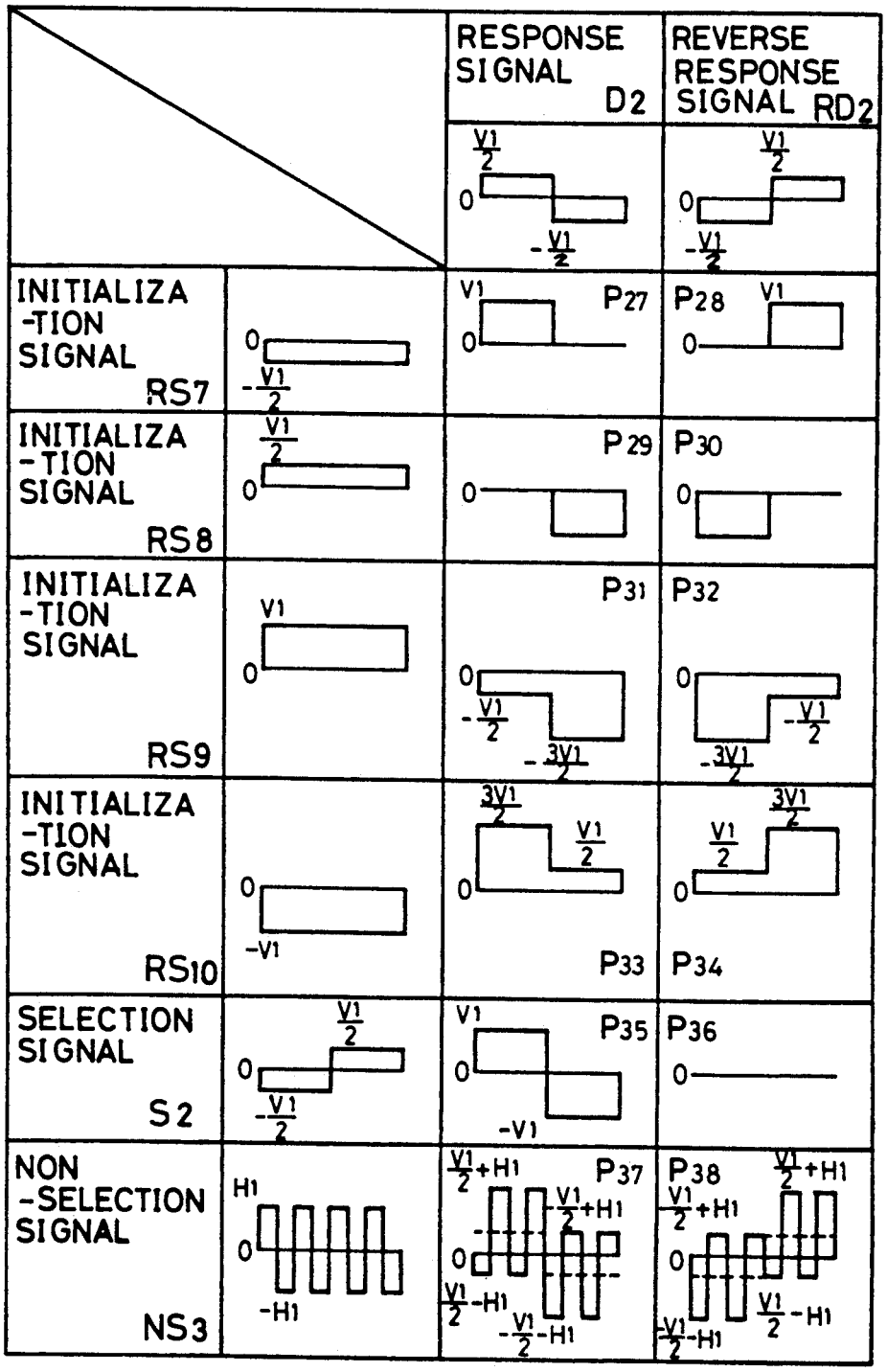

FIG. 8 shows another waveform example. With these waveforms, the similar drive to the above embodiment can be realized but the number of initialization signals is reduced Namely, initialization to the saturated reverse response condition can be realized with only the initialization signals $RS_8$ and $RS_9$ and the initialization to the response condition less than the threshold value is carried out only with the initialization signal $RS_{10}$. In addition, the pulse group $P_{37}$ or $P_{38}$ having the high frequency AC element is applied during the nonselection period and thereby the response condition can be held stably by the AC stabilizing effect. It is desirable to set the frequency of high frequency AC pulse to an integer multiple less than 4 times the frequency of the response control pulse and the pulse amplitude $H_1$ is adequately determined to stably hold the response condition due to the negative dielectric anisotropy of the ferroelectric liquid crystal.

Figure 9:
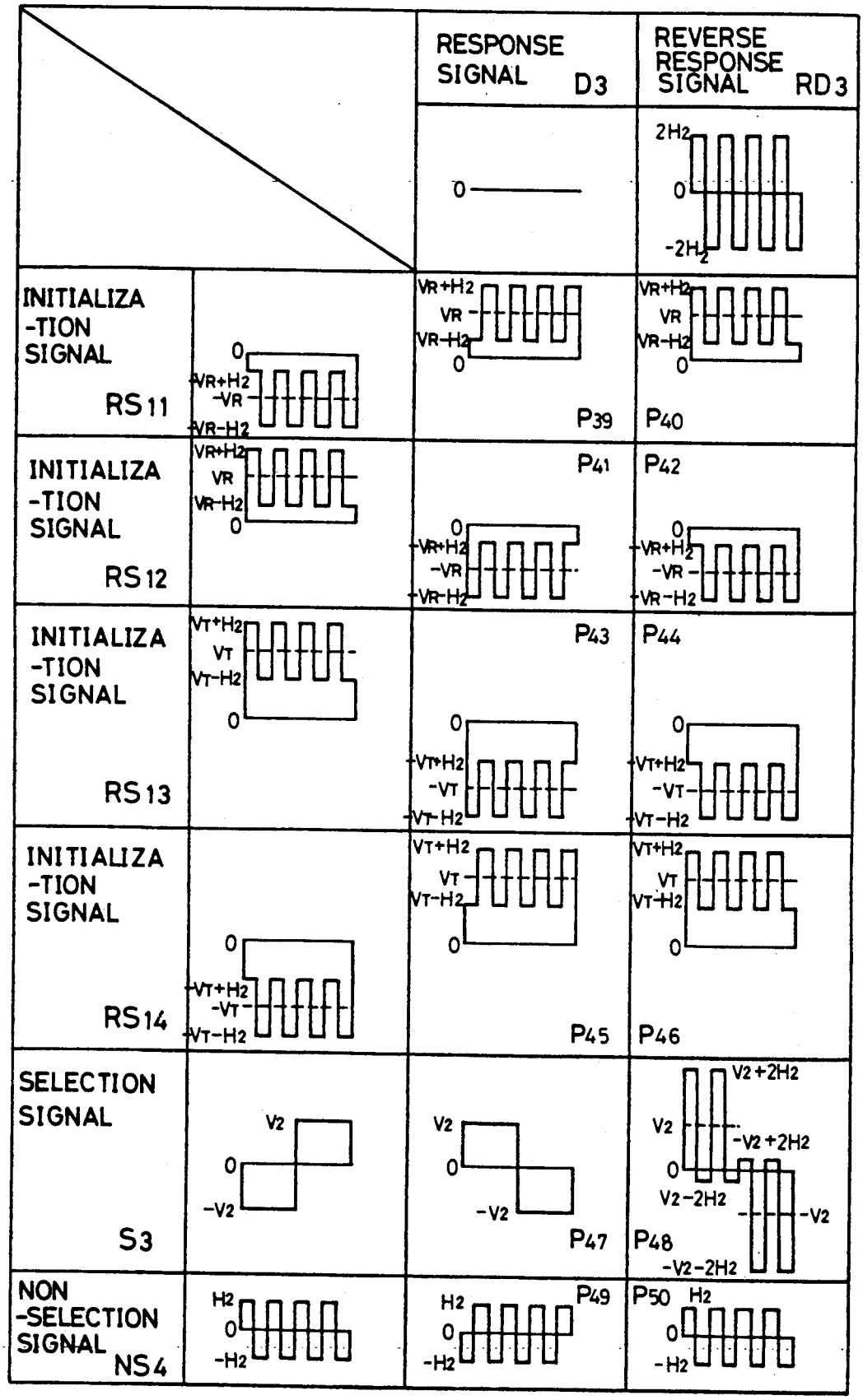

Next, another waveform example utilizing the AC stabilizing effect is explained hereunder. In FIG. 9 after application of pulse group $P_{39}$ or $P_{40}$ where the high frequency AC pulse of voltage $\pm H_2$ is superposed to the DC pulse of voltage $V_R$ by the initialization signal $RS_{11}$, the pulse group $P_{43}$ or $P_{44}$ where the high frequency AC pulse of voltage $\pm H_2$ is superposed to the DC pulse of voltage $-V_T$ in the same polarity is applied to the pixels, following to the pulse group $P_{41}$ or $P_{42}$ where the high frequency AC pulse of voltage $\pm H_2$ is superposed to the DC pulse of voltage $V_R$ by the initialization signal $RS_{11}$ by the supply of initialization signals $RS_{12}$, $RS_{13}$ in order to initialize the pixels to the saturated reverse response condition. Moreover, the pulse group $P_{45}$ or $P_{46}$ where the high frequency AC pulse of voltage $\pm H_2$ is superposed to the DC pulse of voltage $V_T$ by the supply of initialization signal $RS_{14}$ is supplied to the pixels in order to initialize the pixels to the response condition less then the threshold value. Thereafter, the pulse group $P_{47}$ of the voltage $\pm V_2$ is supplied to the response pixels by the selection signal $S_3$ and response signal $D_3$ in order to initialize the pixels to the saturated response condition. On the other hand, the pulse group $P_{48}$ is supplied to the reverse response pixels by the selection signal $S_3$ and reverse response signal $RD_3$. However, since the pulse group $P_{48}$ is formed by superposing the high voltage high frequency AC pulse of the voltage $\pm 2H_2$ to the low frequency AC pulse of voltage $\pm V_2$, the pixels are not initialized to the saturated response condition by the AC stabilizing effect of the voltage $\pm 2H_2$ and the pixels are held under the saturated reverse response condition. Thereafter, the high frequency AC pulse group $P_{49}$ or $P_{50}$ of voltage $\pm H_2$ is applied to the pixels by the nonselection signal $NS_4$ and the response condition is stabilized by the AC stabilizing effect.

The pulse amplitude $V_2$ and pulse width are adequately determined to drive the response condition near to the initialized threshold value to the saturated response condition. Moreover, frequency and pulse amplitude $H_2$ of the high frequency AC pulse are desirably determined to stably hold the response condition.

In addition, the pulse amplitude $V_T$ is desirably determined so that the response condition near to the threshold value can be obtained under the condition that the high frequency AC pulse of voltage $\pm H_2$ is superposed, while the pulse amplitude $V_R$ is adequately determined to obtain the saturated reverse response condition by cooperation of the pulse group $P_{43}$ or $P_{44}$ of the voltage $-V_T \pm H_2$ and the pulse group $P_{41}$ or $P_{42}$ of the voltage $-V_R \pm H_2$.

Figure 10:
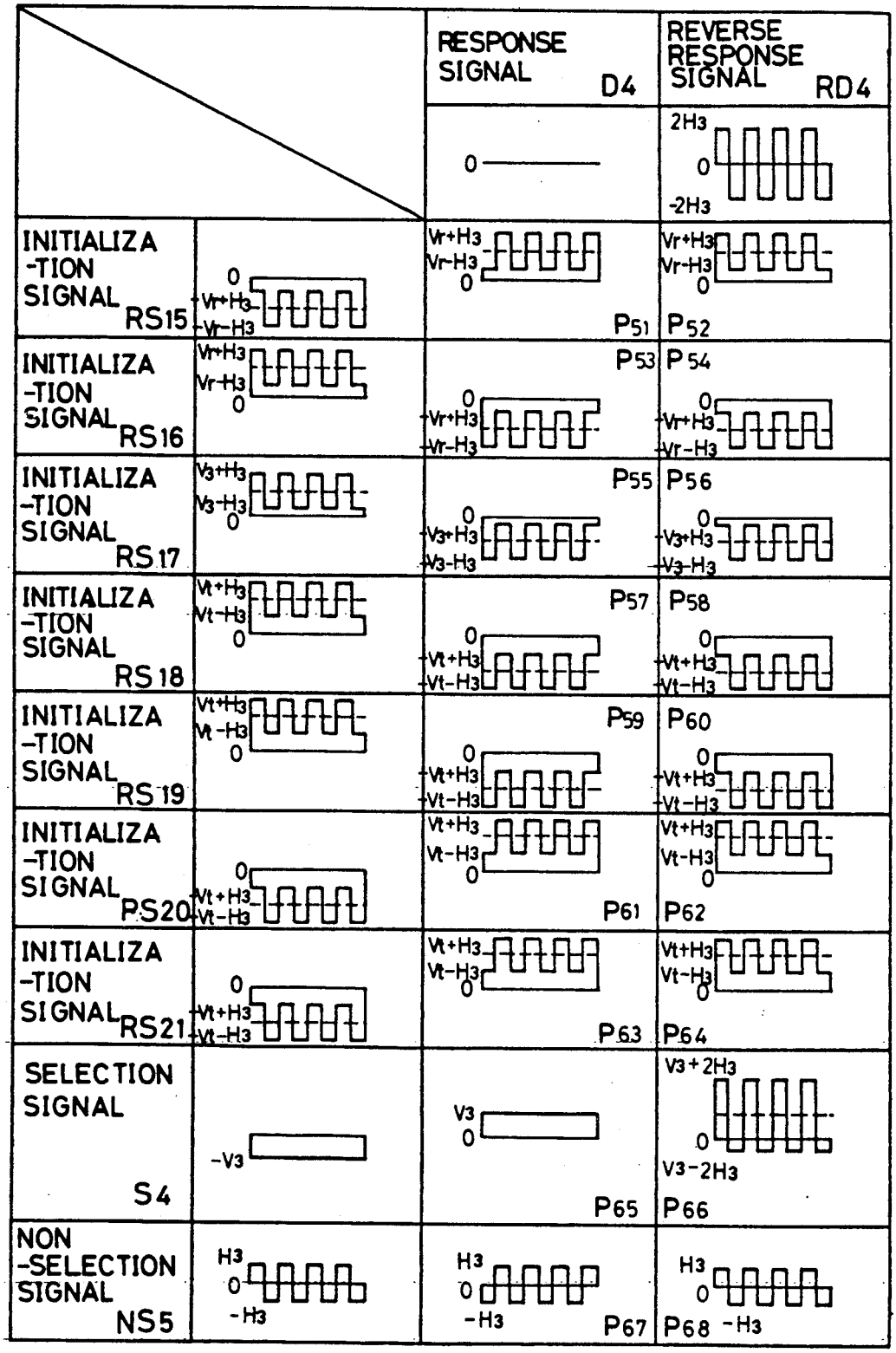
Figure 11:
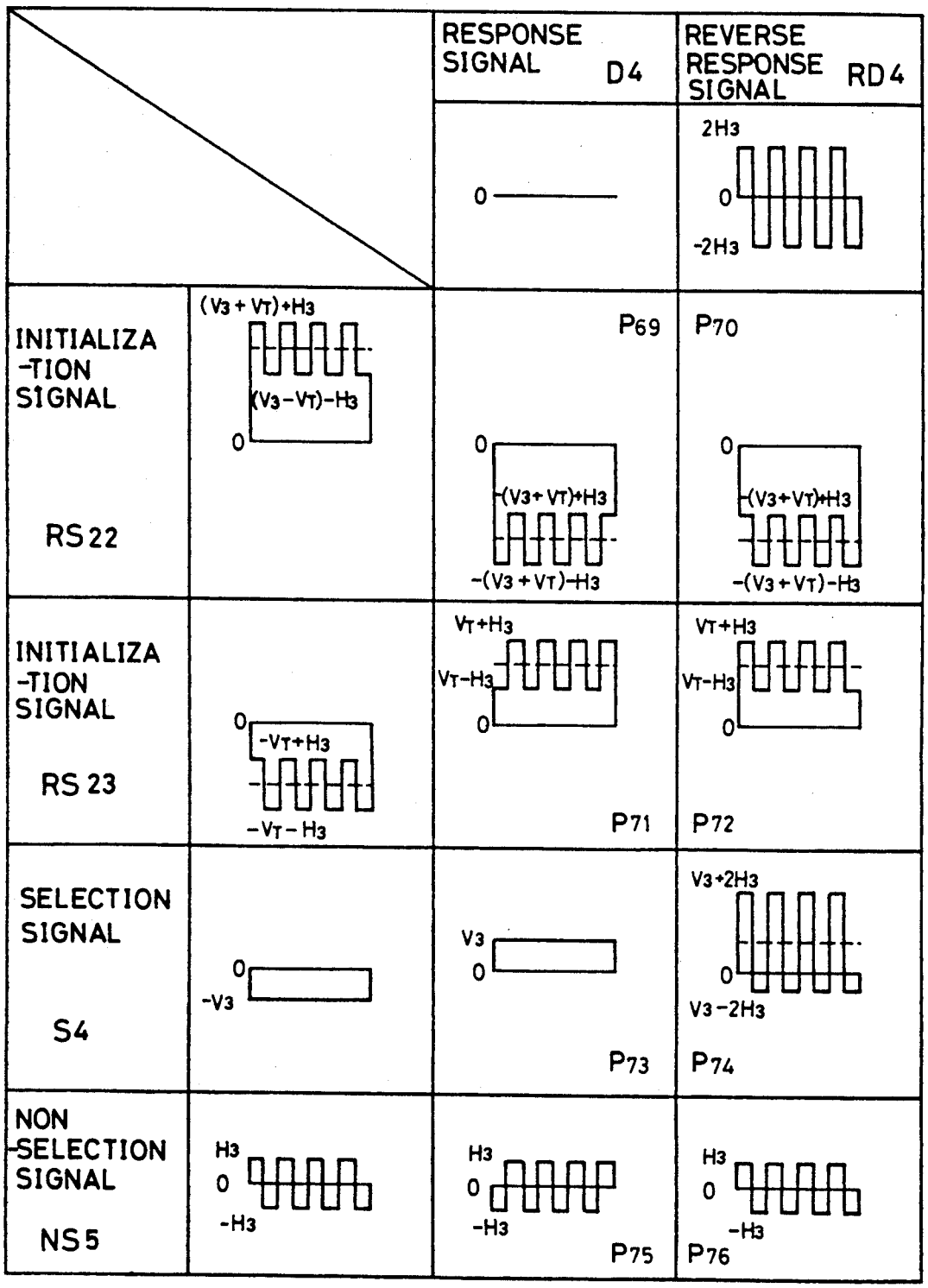

FIG. 10 and FIG. 11 show another waveform example which carries out the driving similar to that of FIG. 9. The scanning can be realized as high as double in speed than the example of FIG. 9 by applying the DC pulse (response control pulse) during the selection period. In order to prevent continuous application of DC element to the display element, blackening of transparent electrodes, discoloration of dichroism pigment and deterioration of liquid crystal can be eliminated by making zero the mean voltage level to be applied to the pixels when both the initialization signal and selection signal are supplied in such a manner that the DC element of reverse polarity is supplied to the initialization signal.

In FIG. 10, after application of the pulse group $P_{51}$ or $P_{52}$ of voltage $V_r \pm H_3$ by the supply of the initialization signal $RS_{15}$, the pulse group $P_{53}$ or $P_{54}$ of the voltage $-V_4 \pm H_3$, the pulse group $P_{55}$ or $P_{56}$ of the voltage $-V_3 \pm H_3$, the pulse group $P_{57}$ or $P_{58}$ and $P_{59}$ or $P_{60}$ of the voltage $-V_t \pm H_3$ are continuously supplied to the pixels by the supply of the initialization signals $RS_{16}$, $RS_{17}$, $RS_{18}$ and $RS_{19}$ in order to once initialize the saturated reverse response condition and the pulse groups $P_{61}$ or $P_{62}$ and $P_{63}$ or $P_{64}$ of the voltage $V_t \pm H_3$ are then applied to the pixels by the supply of initialization signals $RS_{20}$ and $RS_{21}$ in order to initialize the pixels to the response condition near to the threshold value. Thereafter, the DC pulse $P_{65}$ of the voltage $V_3$ is applied to the response pixels by the selection signal $S_4$ and response signal $D_4$ in order to initialize the pixels to the saturated response condition, while the pulse group $P_{66}$ where the high frequency AC pulse of the voltage $\pm 2H_3$ is superposed to the DC pulse of the voltage $V_3$ is supplied to the reverse response pixels by the selection signal $S_4$ and reverse response signal $RD_4$. The pixels are not initialized to the saturated response condition due to the AC stabilizing effect and the pixels are held in the saturated reverse response condition. Subsequently the high frequency AC pulse of the voltage $\pm H_3$ is supplied to the pixels by the nonselection signal $NS_5$ and the pixels are stabilized to the response condition.

Figure 12:
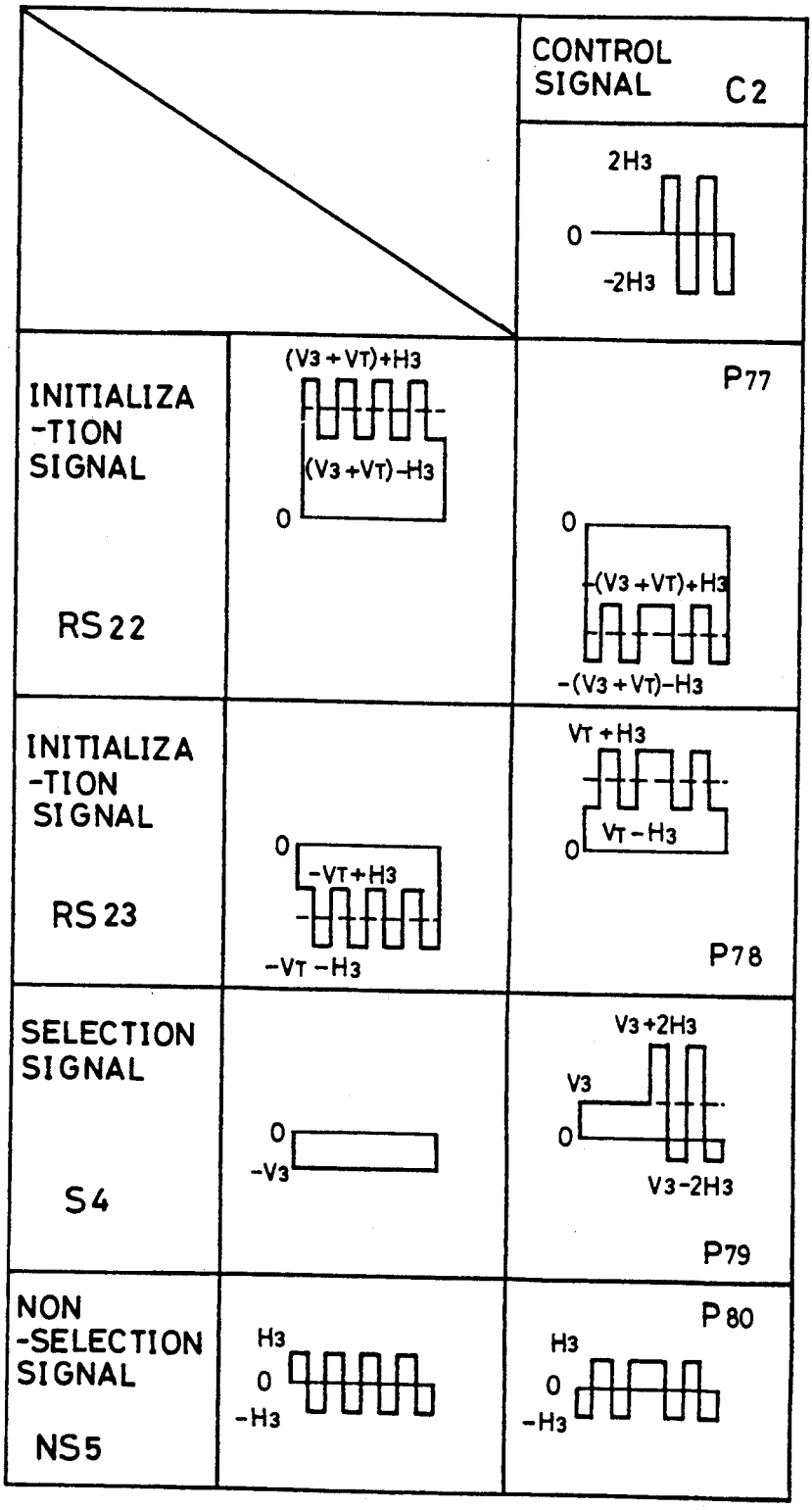

FIG. 11 is an example where the number of initialization signals is reduced. FIG. 12 is an example of diplaying the intermediate tone by applying the example of FIG. 11. The time duration of the DC pulse $V_3$ during the selection period is controlled and the nonsaturated response condition (intermediate tone) can be displayed by controlling the cycle (rate of application time of the voltages $\pm 2H_3$ and 0) of high frequency AC pulse $\pm 2H_3$ of the control signal $C_2$ in accordance with the tone in FIG. 12.

Figure 13:
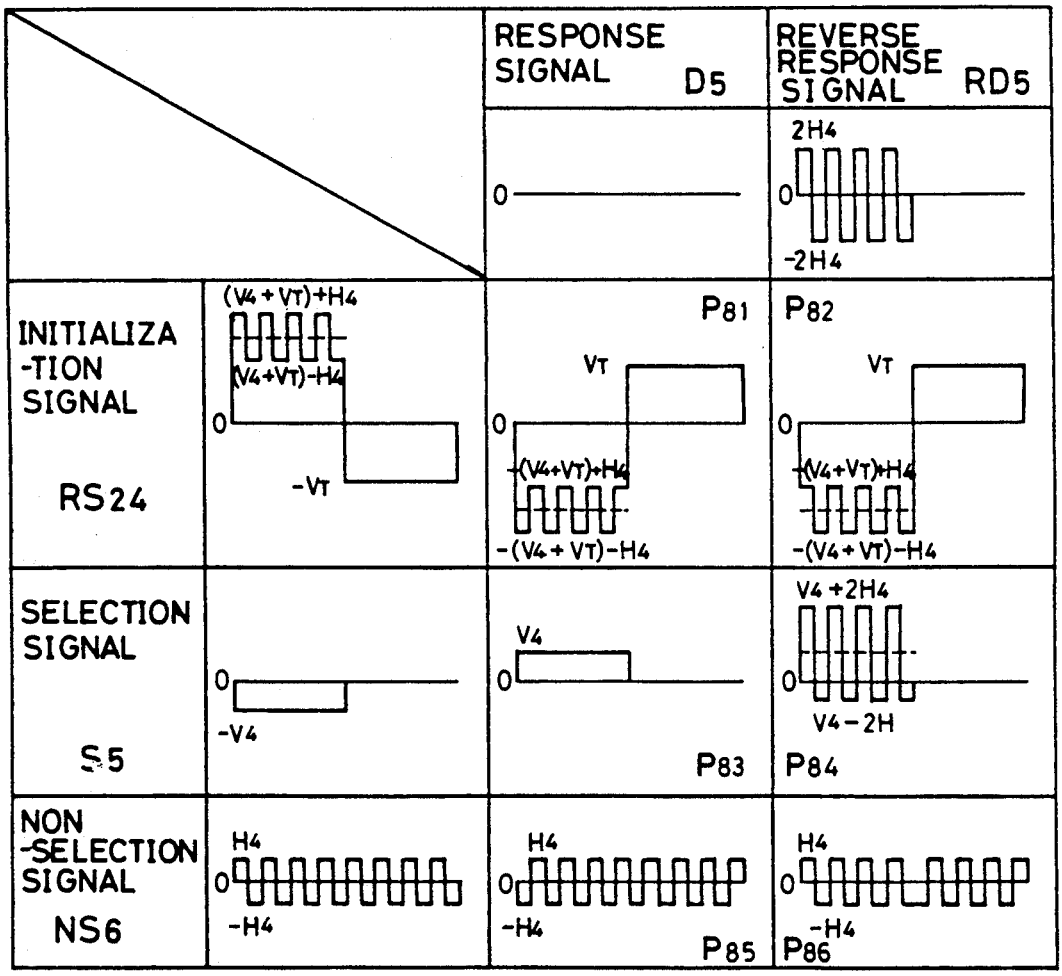

FIG. 13 shows an example where the number of initialization signals is further reduced. In FIG. 13, the pulse group $P_{81}$ or $P_{82}$ is applied to the pixels by the supply of initialization signal $RS_{24}$. The pulse groups $P_{81}$, $P_{82}$ are composed of the voltages $-(V_4+V_T) \pm H_4$ and $V_T$ and the pixels are initialized to the saturated reverse response condition with the former pulse of $-(V_4+V_T) \pm H_4$ and is then initialized to the response condition near to the threshold value by the latter pulse $V_T$. Thereafter, the pulse group $P_{83}$ composed of the voltages $V_4$ and 0 is applied to the response pixels by the selection signal $S_5$ and response signal $D_5$ and the pixels are set to the saturated response condition by the DC pulse cf voltage $V_4$. On the other hand, the pulse gourp $P_{84}$ where the high frequency AC pulse of the voltage $\pm 2H_4$ is superposed is applied to the reverse response pixels by the selection signal $S_5$ and the reverse response signal $RD_5$. Thereby the pixels are not initialized to the saturated response condition and the pixels are held to the saturated reverse response condition. Thereafter, the high frequency AC pulse group $P_{85}$ or $P_{86}$ is applied by the nonselection signal $NS_6$ in order to stabilize the response condition.

Figure 14:
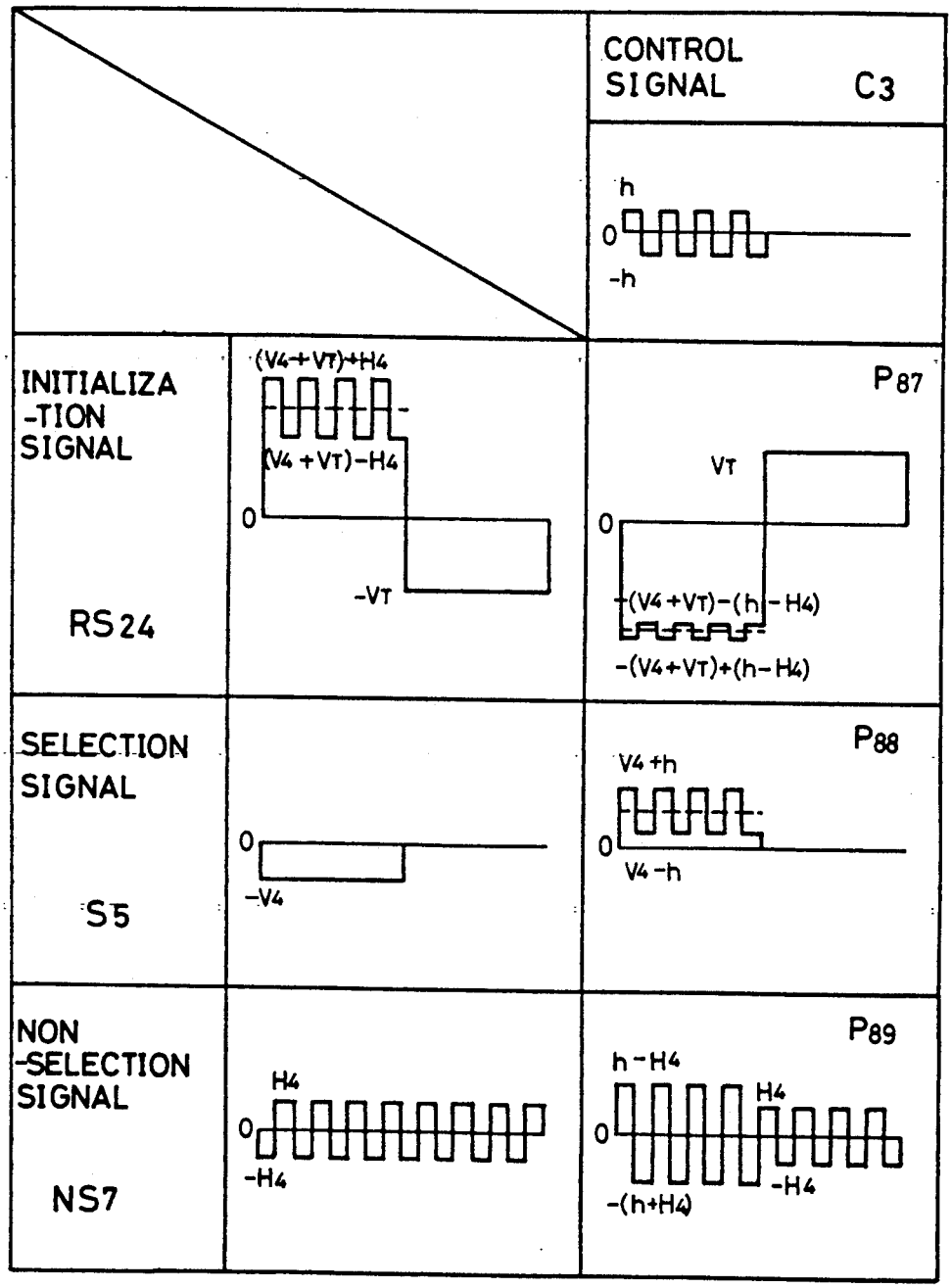

FIG. 14 shows the waveforms for displaying intermediate tone by applying the example of FIG. 13 and the unsaturated response condition (intermediate tone) can be displayed by controlling the pulse amplitude h of the high frequency AC pulse superposed to the DC pulse of volage $V_4$ depending on the gradation.

In addition, since the nonselection signal $NS_7$ stabilizes further the AC stabilizing effect during the nonselection period, it has a phase difference of 180° to the nonselection signal $NS_6$.

In the above explanation, the term "response" is used for the positive voltage while the term "reverse response" is used for the negative voltage. However, the response and reverse response are correlative, the term "reverse response" may be used for the positive voltage and the term "response" may be used for the negative voltage.

The signals to be supplied to respective electrodes are not limited only to those mentioned above and various modifications are allowed. Moreover, it is also possible to apply a bias voltage adequately as required. Moreover, the number of initialization signals and sequence thereof are also not limited to those described above and it is enough when the pixels are once initialized to the saturated reverse response condition before supply of the selection and are then initialized to the response condition less than the threshold value.

Furthermore, the embodiment mentioned above refers to the matrix display shown in FIG. 1 but it is not limited only to such matrix display and the present invention can naturally be adopted to the driving of the liquid crystal shutter array for an optical printer where the optical shutter array arranged in the form of a line is divided for each of the plural blocks and these are wired like a matrix. In this case, high contrast can be realized by setting the reverse response condition for initialization to the dark condition of the display.

[Effect of the Invention]

According to the present invention, the next line can previously be initialized by the supply of an initialization signal simultaneously with the supply of selection signal and moreover the line is initialized up to the response condition near to the threshold value. Therefore, the pulse duration of selection signal can be reduced and rewriting period of display can be shortened remarkably. In addition, low voltage drive can be realized in the case where the rewriting period is set to a constant. Moreover, since the signal applied during nonselection period can be set relatively smaller than the signal for obtaining the saturated response condition or saturated reverse response condition and the stabilized dark level can be obtained through a small fluctuation of transmitting light during the nonselection period, a high contrast display can be realized. Furthermore, application of the AC stabilizing effect realizes a stable display with high response condition holding capability during the nonselection period and large driving margin and can drive the display panel under the various orientation conditions such as monostable and nonmemory, etc. which may be manufactured easily.

Blackening of transparent electrodes, discoloration of dichroism pigment and deterioration of liquid crystal can be eliminated even after a long time drive by equalizing the waveform or a number of pulses in different polarilities of the pulse group applied to the display elements or setting a mean voltage level of such pulses to 0 within the one period of scanning.

The present invention also provides such excellent effect as realizing a display of intermediate color tone.

I claim:

1. A method for driving a liquid crystal optical apparatus having a matrix of pixels formed by ferroelectric liquid crystal interposed between a scanning electrode group and a control electrode group, comprising:

sequentially applying signals to the scanning electrode group and the control electrode group wherein the voltage difference therebetween sequentially forms a first pulse group, a partial response pulse, a second pulse group and a third pulse group applied to the pixels, wherein the first pulse group initializes the ferroelectric liquid crystal to a saturated reverse response condition, wherein said partial response pulse holds the ferroelectric liquid crystal to the saturated reverse response condition and prepares the ferroelectric liquid crystal to turn to a desired response condition, wherein the second pulse group turns the ferroelectric liquid crystal to the desired response condition in cooperation with said partial response pulse, said desired response condition including one of the saturated response condition, the saturated reverse response condition and an intermediate condition, wherein the third pulse group holds the desired response condition, and wherein the mean voltage level applied to the ferroelectric liquid crystal is O.

2. A method for driving a liquid crystal optical apparatus according to claim 1, wherein the pulses applied to the ferroelectric liquid crystal within one scan period comprise AC pulses having pulses of one polarity and pulses of the other polarity, the number and waveform of the pulses of each polarity being the same.

3. A method for driving a liquid crystal optical apparatus according to claim 1, where the ferroelectric liquid crystal has an AC stabilizing effect.

4. A method for driving a liquid crystal optical apparatus according to claim 3, where the third pulse group comprises high frequency AC pulses effective to hold the desired response condition.

5. A method for driving a liquid crystal optical apparatus according to claim 4, wherein the ferroelectric liquid crystal has negative dielectric anisotropy in the frequency band of the high frequency AC pulses.

6. A method of driving a ferroelectric liquid crystal optical apparatus having a matrix of pixels formed between a group of scanning electrodes and a group of control electrodes, wherein each pixel is drivable into a saturated response condition and a saturated reverse response condition in response to at least one pulse with a product of amplitude and pulse duration in a given time period having an absolute value no less than a threshold value and drivable into a non-saturated intermediate condition in response to at least one pulse with a product of amplitude and pulse duration in the given time period having an absolute value less than said threshold value, said method comprising:

applying control signals to the scanning electrodes and control electrodes during each of a plurality of sequential scan periods such that each of the scanning electrodes is sequentially selected to drive each pixel to a desired one of the saturated reverse response condition, the intermediate condition and the saturated response condition and to maintain each pixel in the desired condition until the next scan period therefor, the control signals being applied in each scan period to the scanning and control electrodes to establish a voltage difference therebetween applied to each pixel to sequentially form a first pulse group initializing the pixel into one saturated condition, at least one partial response pulse following the first pulse group having a product of amplitude and pulse duration less than the threshold value to maintain the pixel in the one saturated condition and prepare the pixel to turn into the desired response condition, a second pulse group following the at least one partial response pulse within the given time period and operative therewith to drive the pixel into the desired response condition including maintaining the pixel in the one saturated condition or turning the pixel into an intermediate condition or the other saturated condition, and a third pulse group following the second pulse group maintaining the pixel in the desired response condition until the first pulse group of the next scan period, and wherein the mean voltage level applied to each pixel during one scan period is zero.

7. The method according to claim 6, wherein the pulses applied to each pixel within one scan period comprise AC pulses having pulses of one polarity and pulses of the other polarity, the number and waveform of the pulses of each polarity being the same.

8. The method according to claim 6, wherein the third pulse group comprises high frequency AC pulses effective to hold the desired response condition.

9. The method according to claim 8, wherein the AC pulses of the third pulse group have a frequency sufficient to enable the liquid crystal to exhibit negative dielectric anisotropy.

* * * * *